US006231487B1

(12) United States Patent
Diamond, Jr. et al.

(10) Patent No.: US 6,231,487 B1
(45) Date of Patent: May 15, 2001

(54) APPARATUS FOR STIMULATING HAMSTRING CONTRACTION TO EFFECT OPTIMUM ABDOMINAL MUSCLE CONDITIONING

(76) Inventors: John P. Diamond, Jr., 27 Williamsburg Dr., Cheshire, CT (US) 06410; William A. Zarillo, 93 Malvern Hill Rd., Watertown, CT (US) 06795

( * ) Notice: Subject to any disclaimer, the term of this patent is extended or adjusted under 35 U.S.C. 154(b) by 0 days.

(21) Appl. No.: 09/249,466

(22) Filed: Feb. 12, 1999

Related U.S. Application Data

(63) Continuation-in-part of application No. 08/998,515, filed on Dec. 26, 1997, now Pat. No. 5,957,820.

(51) Int. Cl.[7] ..... A63B 21/045
(52) U.S. Cl. ..... 482/121; 482/122; 482/127
(58) Field of Search ..... 482/121, 122, 482/127, 140, 145, 130, 123

(56) References Cited

U.S. PATENT DOCUMENTS

| | | | | |
|---|---|---|---|---|
| D. 339,618 | | 9/1993 | Hassell | D21/191 |
| 3,567,218 | | 3/1971 | Johnson . | |
| 4,483,533 | * | 11/1984 | Mangiapane | 482/121 |
| 4,508,335 | | 4/1985 | Kelley et al. . | |
| 4,509,748 | | 4/1985 | Bezak . | |
| 4,756,522 | * | 7/1988 | Sandoval | 482/121 |
| 5,009,417 | | 4/1991 | Sarkozi . | |
| 5,106,083 | | 4/1992 | Hall | 482/145 |
| 5,176,622 | * | 1/1993 | Anderson et al. | 482/105 |
| 5,224,914 | * | 7/1993 | Friedman | 482/127 |
| 5,403,258 | | 4/1995 | Hill | 482/192 |
| 5,545,114 | | 8/1996 | Gvoich | 482/140 |
| 5,669,862 | | 9/1997 | Sayman | 482/127 |

* cited by examiner

*Primary Examiner*—Jerome W. Donnelly
(74) *Attorney, Agent, or Firm*—Raymond A. Nuzzo

(57) ABSTRACT

A muscle strengthening apparatus comprising a substantially arch-shaped member having a first end and a second end, the arched-shaped member having a predetermined degree of resiliency, an ankle contact member having a pair of ankle contact portions for contacting the ankles of a user, the ankle contact member being attached to the arch-shaped member adjacent to the first end, and a buttocks contact member for contacting the buttocks of the user, the buttocks contact member being attached to the arch-shaped member adjacent the second end.

17 Claims, 13 Drawing Sheets

APPARATUS FOR STIMULATING HAMSTRING CONTRACTION TO EFFECT OPTIMUM ABDOMINAL MUSCLE CONDITIONING

This application is a continuation-in-part application based on commonly owned and U.S. application Ser. No. 08/998,515 filed Dec. 26, 1997, now U.S. Pat. No. 5,957, 820.

BACKGROUND OF THE INVENTION

COPYRIGHT NOTICE

©Copyright 1997–99, William Zarillo and John P. Diamond, Jr. All rights reserved.

A portion of the disclosure of this patent document contains material that is subject to copyright protection. The copyright owner has no objection to the facsimile reproduction by anyone of the patent document or the patent disclosure, as it appears in the USPTO patent file or records, but otherwise reserves all copyright rights whatsoever.

1. Field of the Invention

The present invention relates to an apparatus for exercising and strengthening muscles of the human body.

2. Problem to be Solved

Abdominal weakness is a common problem. Physicians and personal trainers have advocated the use of the "sit-up" and/or exercise as a means of strengthening abdominal muscles. However, these conventional methods of sit-ups or crunches are ineffective and inefficient because they involve more of the hip-flexors than the abdominals.

Conventional devices for exercising and strengthening abdominal muscles are inefficient because the effort expended by the users of such devices is predominately directed to exercising the hip flexor rather than strengthening the abdominal muscles. Furthermore, many conventional exercise devices overdevelop the hip flexors, particularly the iliopsoas, which can contribute to the pouching of the lower abdominal area.

It is therefore an object of the present invention to provide a muscle strengthening apparatus for exercising and strengthening abdominal muscles which solves the aforementioned problems related to traditional sit-up exercises and addresses the deficiencies of conventional devices.

It is another object of the present invention to provide a muscle strengthening apparatus for exercising and strengthening abdominal muscles and which also simultaneously exercises and strengthens other muscles.

It is a further object of the present invention to provide a muscle strengthening apparatus for exercising and strengthening abdominal and other muscles that is easy to use.

It is yet another object of the present invention to provide a muscle strengthening apparatus for exercising and strengthening abdominal muscles that is inexpensive to manufacture.

Still other objects and advantages of the present invention will in part be obvious and will in part be apparent from the specification.

SUMMARY OF THE INVENTION

The above and other objects, which will be apparent to those skilled in the art, are achieved in the present invention which is directed to, in a first aspect, a muscle strengthening apparatus comprising a substantially arch-shaped member having a first end and a second end. The arched-shaped member has a predetermined degree of resiliency. The apparatus further comprising an ankle contact member having a pair of ankle contacts for contacting the ankles of a user. The ankle contact member is attached to the arch-shaped member adjacent to the first end. The apparatus further including a buttocks contact member for contacting the buttocks and/or at least a portion of the posterior thighs of the user. The buttocks contact member is attached to the arch-shaped member adjacent the second end.

BRIEF DESCRIPTION OF THE DRAWINGS

The features of the invention are believed to be novel. The figures are for illustration purposes only and are not drawn to scale. The invention itself, however, both as to organization and method of operation, may best be understood by reference to the detailed description which follows taken in conjunction with the accompanying drawings in which.

DETAILED DESCRIPTION OF THE INVENTION

1. Definitions

In order to facilitate understanding of the purpose and effectiveness of the present invention as well as the ensuing description, the terms shown below have been defined accordingly:

a) As used herein, the terms "abdominal muscles", "abdominals" or "rectus abdominals" refer to the muscles that connect the lower ribs and xiphoid to the pubic bone. These muscles allow flexing of the spine (curling the trunk) and cause the pelvis to posteriorly tilt.

b) As used herein, the terms "obliques" and "transverse abdominus" refer to groups of muscles that are located on the side of the abdominals. The obliques and transverse abdominus cooperate to flex the spine and pull in or retract the stomach. Unilaterally, the obliques and transverse abdominus flex the spine laterally and obliquely.

c) As used herein, the term "psoas" or "iliopsoas", refers to muscles that are located anterior to the pelvis and inserted on the lumbar spine to the femur. The "psoas" are relatively stronger than the abdominals. The psoas muscles allow flexing of the spine and femur in a forward direction.

d) As used herein, the term "hamstring" or "hamstrings" refers to the muscles in the leg that extend the femur backwards and cause the pelvis to posteriorly tilt. When the hamstrings are contracted, they contribute to the inhibition of the psoas muscles and rectus femoris.

e) As used herein, the term "Gluteus Maximum", or "Gluts" refer to the muscles that are located posterior to the pelvis and inserted on the pelvis to the femur. When the Gluts contract, they can contribute to the inhibition of the psoas muscle.

f) As used herein, the term "rectus femoris" refers to muscles that are located anteriorly to the femor. These muscles flex the femor in the forward direction.

In describing the preferred embodiments of the present invention, reference will be made herein to FIGS. 1–23 of the drawings in which like numerals refer to like features of the invention.

2. First Embodiment

Figure 2:
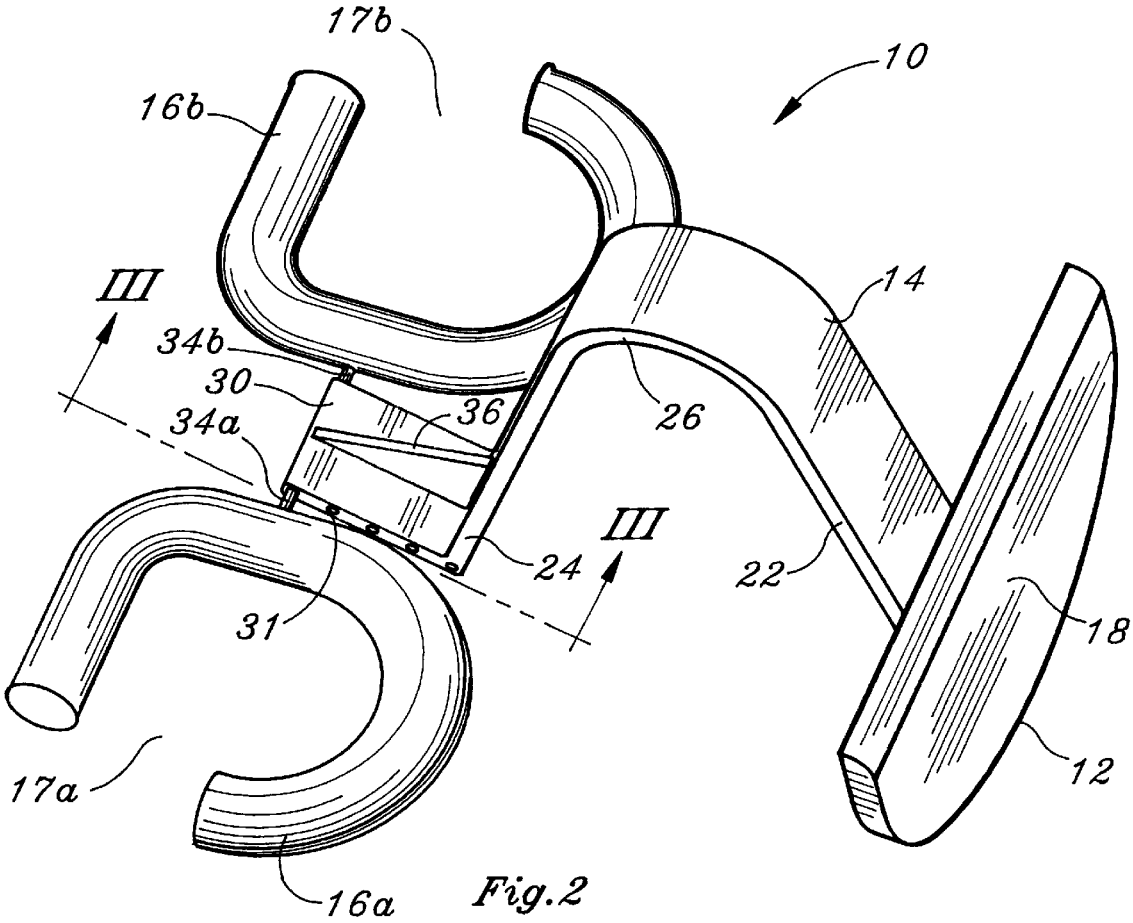
FIG. 2 is a perspective view of one embodiment of the muscle strengthening apparatus of the present invention.
Figure 4:
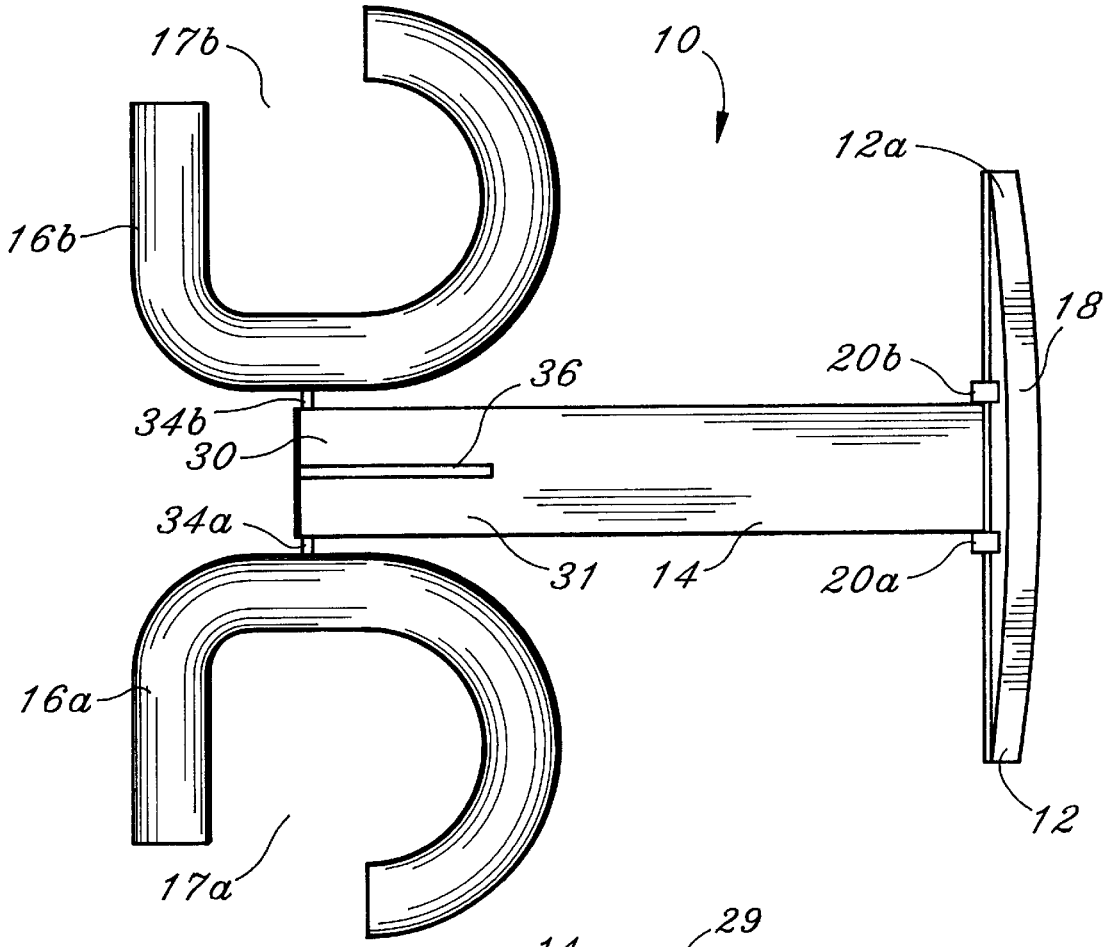
FIG. 4 is a top plan view of the muscle strengthening apparatus of FIG. 2.
Figure 5:
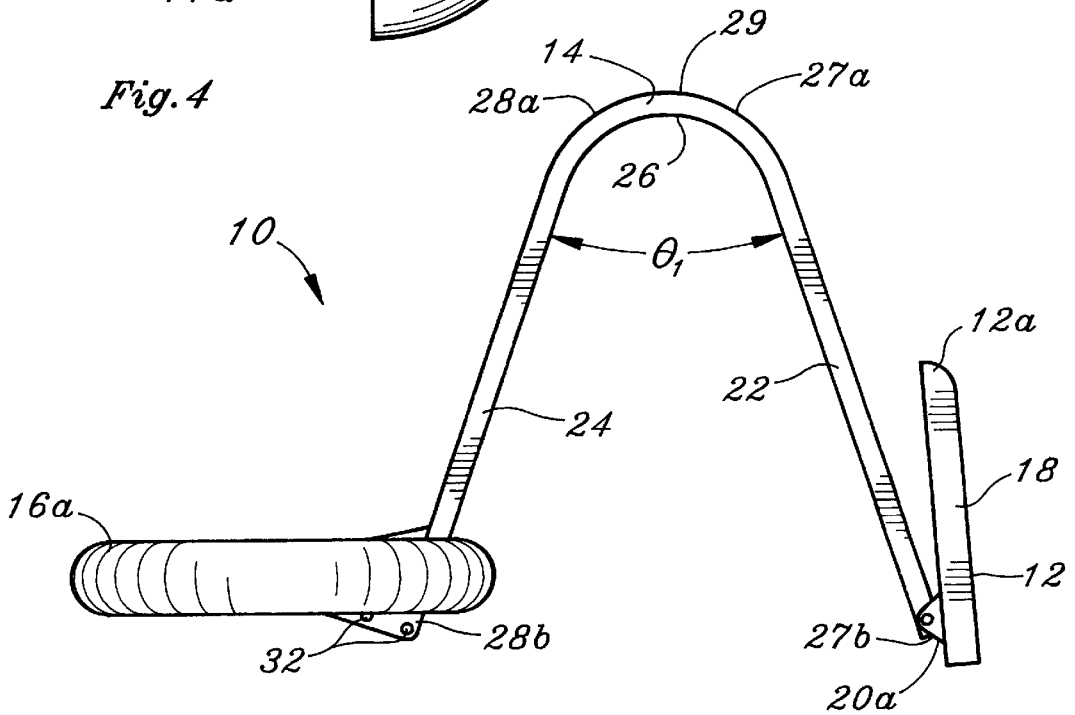
FIG. 5 is a side-elevational view of the apparatus of FIG. 2.

Referring to FIGS. 2, 4 and 5 show one embodiment of the muscle strengthening apparatus of the present invention. Apparatus 10 generally comprises buttocks support member 12, intermediate or central torsion member 14 and ankle supports 16*a* and 16*b*. Buttocks support member 12 contacts the buttocks and/or posterior thighs of the user. Support member 12 has top surface 18 that is configured with a predetermined contour that corresponds to the bone and muscular structure between the buttocks (gluteus maximus) and the upper hamstrings of the human anatomy. In a preferred embodiment, support member 12 has a substantially semi-circular shape, is substantially rigid and is fabricated from lightweight, durable materials such as plastic, rubber, fiberglass, graphite or other composite materials. Support member 12 may also have shapes other than the semi-circular. Support member 12 has mounts 20*a*, 20*b* for attachment to intermediate member 14. In a preferred embodiment, mounts 20*a*, 20*b* of support member 12 are rigidly attached to end portion 27*b*. In an alternate embodiment, mounts 20*a* and 20*b* are pivotally mounted to end 27*b*.

Referring to FIG. 5, intermediate member 14 comprises portions or sides 22 and 24. Sides 22 and 24 are attached to one another. The point of attachment or contiguity is designated generally by numeral 26. In a preferred embodiment, sides 22 and 24 are angulated with respect to each other by angle $\theta_1$ (see FIG. 5). In a preferred embodiment, $\theta_1$ is between about 70° and 100°, inclusive. In a more preferred embodiment, $\theta_1$ is between 80° and 90°. In a most preferred embodiment, $\theta_1$ is about 90°. The lengths of sides 22 and 24 are substantially equal. Side 22 has end portions 27*a* and 27*b*. Side 24 has end portion 28*a* and 28*b*. In a preferred embodiment, end portions 27*a* and 28*a* are preferably curved in order to form curved or rounded portion 29. The purpose of curved portion 29 will be discussed below.

Referring to FIG. 2, in a preferred embodiment, intermediate member 14 is resilient. The thickness of member 14 depends upon the required degree of resistance or resiliency. In a preferred embodiment, member 14 has a substantially square or rectangular cross-sectional shape in order to reduce torsional twisting of member 14. However, member 14 may also have other cross-sectional shapes. Member 14 is preferably made from durable, flexible materials such as plastic, flexiglass or fiberglass. However, other materials having the required durability and flexibility may also be used.

Figure 3:
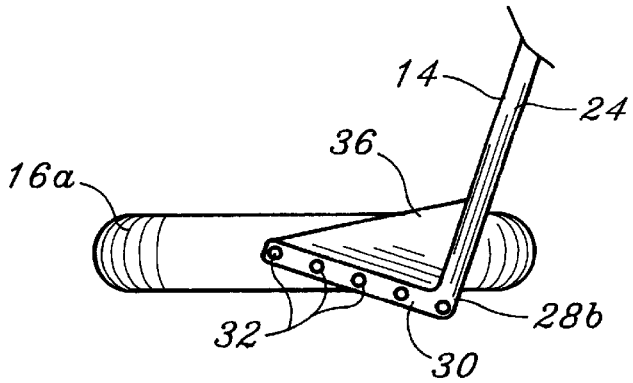
FIG. 3 is a view taken along line 3—3 of FIG. 2.

Referring to FIGS. 2, 3 and 4, support member 30 is attached to end 28 of side 24. Support member 30 has top surface 31 and a plurality of laterally oriented bores 32 formed therein. Each bore 32 is sized to slidably receive pins or axles 34*a*, 34*b* that are attached to ankle supports 16*a* and 16*b*, respectively. The plurality of bores 32 allow the position of ankle supports 16*a*, 16*b* to be varied according to the height of the user. In a preferred embodiment, the number of bores 32 is sufficient to allow ankle supports 16*a*, 16*b* to be varied between about 3 inches and 6 inches, inclusive. However, other distances may be achieved by increasing the number of bores 32 and the size of support member 30. Gusset or support bracket 36 is attached to top surface 31 of support member 30 and to side 24 of intermediate member 14. Gusset 36 provides structural support for the connection between side 24 and support member 30. In a preferred embodiment, support member 30 and gusset 36 are made of the same materials as intermediate member 14.

Referring to FIGS. 2, 3 and 4, ankle supports 16*a*, 16*b* each have a body portion that defines openings 17*a*, 17*b*, respectively, for receiving the feet and ankles of a user. Ankle supports 16*a* and 16*b* stabilize the feet and ankles to facilitate proper use of apparatus 10 of the present invention. This will be discussed in detail below. Pins or axles 34*a*, 34*b*, which are attached to ankle supports 16*a*, 16*b*, respectively, are slidably and rotatably disposed within bores 32. There is a minimal degree of friction between pins 34*a*, 34*b* and the inner walls (not shown) of the bores 32 in order to prevent pins 34*a*, 34*b* from becoming dislodged from bores 32 while allowing easy removal of pins 34*a*, 34*b* from the bores 32 and rotation of ankle supports 16*a*, 16*b*. Ankle supports 16*a*, 16*b* are able to freely rotate or pivot to provide "self adjustment" as the user uses apparatus 10 and to facilitate storage of apparatus 10 when not in use. In a preferred embodiment, ankle supports 16*a,* 16*b* are able to rotate 360°. The overall structure of each ankle support 16*a,* 16*b* is ergonomic so as to provide comfortable physical contact between the user's ankles and ankle supports 16*a,* 16*b.* The rotational feature and ergonomic design of ankle supports 16*a,* 16*b* substantially eliminate stress and/or strain on the user's ankles. In a preferred embodiment, ankle supports 16*a,* 16*b* have a substantially circular cross-section. Ankle supports 16*a,* 16*b* may take on any one of a variety of geometric shapes, e.g. substantially C-shaped, substantially J-shaped, etc. In a preferred embodiment, ankle supports 16*a,* 16*b* are fabricated from durable, lightweight materials such as metal, plastic, rubber, fiberglass, graphite or other composite materials. In a preferred embodiment, pins or axles 34*a,* 34*b* are fabricated from durable materials that can withstand stress. Preferably, pins or axles 34*a,* 34*b* are fabricated from metal, fiberglass, graphite or other composite materials. As described above, the position of ankle supports 16*a,* 16*b* on support member 30 can be adjusted by inserting pins 34*a,* 34*b* into any of bores 32 formed in support member 30 in order to accommodate users of different height.

3. Second Embodiment

Figure 6:
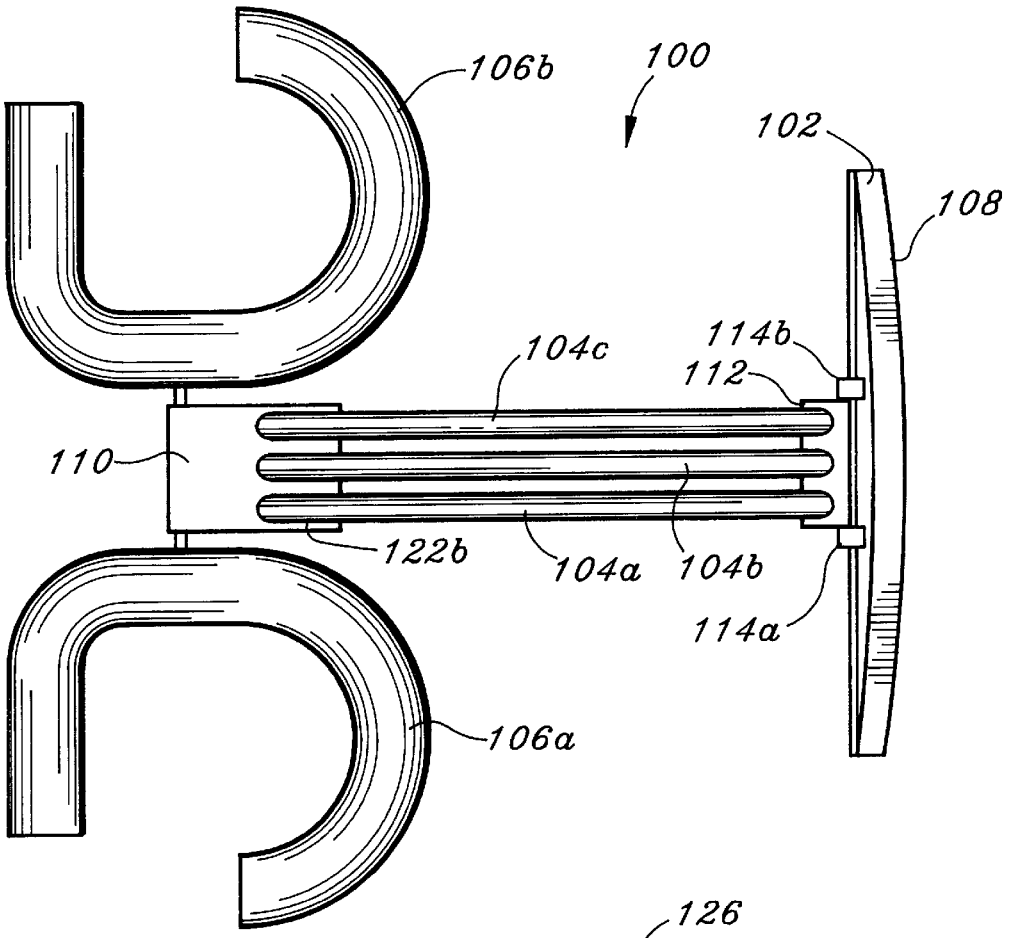
FIG. 6 is a top view of an alternate embodiment of the muscle strengthening apparatus of the present invention.
Figure 7:
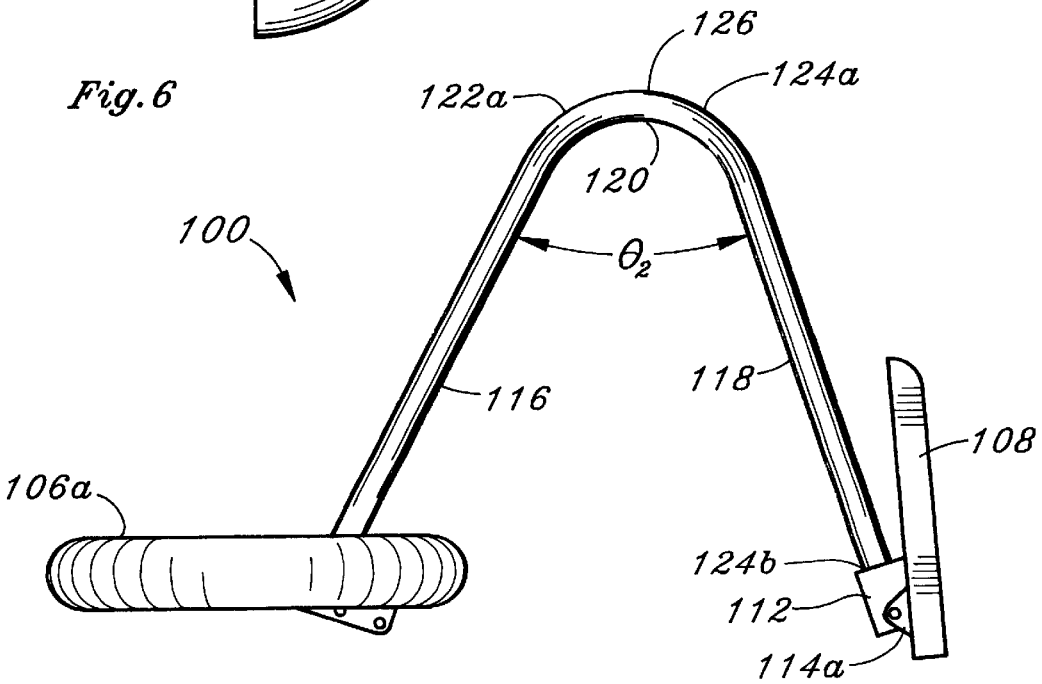
FIG. 7 is a side elevational view of the apparatus of FIG. 6.

Referring to FIGS. 6 and 7, an alternate embodiment 100 of the present invention is shown. Alternate embodiment 100 of the present invention generally comprises buttocks support member 102, intermediate members 104*a,* 104*b* and 104*c* and ankle supports 106*a* and 106*b.* Buttocks support member 102 contacts the buttocks and/or posterior thighs of the user. Apparatus 100 further includes support members 110 and 112. Support member 102 has top surface 108. Surface 108 is configured with a predetermined contour that corresponds to the bone and muscular structure between the buttocks (gluteus maximus) and the upper hamstrings of the human anatomy. In a preferred embodiment, support member 102 has a substantially semi-circular shape, is substantially rigid and is fabricated from lightweight, durable materials such as plastic, rubber, fiberglass, graphite, metal or other composite materials. Support member 102 may have a shape other than semi-circular. Support member 102 has mounts 114*a,* 114*b* for attachment to support member 112. In a preferred embodiment, mounts 114*a,* 114*b* of support member 102 are rigidly attached support member 112. In an alternate embodiment, mounts 114*a* and 114*b* are pivotally attached to support member 112. Other purposes and features of support member 102 will be discussed below.

In order to simplify the ensuing discussion, only intermediate member 104*a* is discussed. However, it is to be understood that the ensuing discussion is also applicable to intermediate members 104*b* and 104*c.* Referring again to FIGS. 6 and 7, intermediate member 104*a* comprises sides or portions 116 and 118. Sides 116 and 118 are connected to one another at a point of attachment or contiguity generally by numeral 120. In a preferred embodiment, sides 116 and 118 are angulated with respect to each other by angle $\theta_2$ (see FIG. 7). In a preferred embodiment, $\theta_2$ is between about 70° and 100°, inclusive. In a more preferred embodiment, $\theta_2$ is between 80° and 90°. In a most preferred embodiment, $\theta_2$ is about 90°. The lengths of sides 116 and 118 are substantially equal. Side 116 has end portions 122*a* and 122*b.* Side 118 has end portions 124*a* and 124*b.* In a preferred embodiment, end portions 122*a* and 122*a* are preferably curved in order to form curved or rounded portion 126. The purpose of curved portion 126 will be evident from the discussion below. In a preferred embodiment, intermediate member 104*a* is resilient. The thickness of member 104*a* depends upon the required degree of resistance or resiliency. Member 104*a* is preferably made from durable, flexible materials such as plastic, flexiglass or fiberglass. However, other materials having the required durability and flexibility may also be used.

Referring to FIG. 6, each member 104*a,* 104*b* and 104*c* has a specific cross-section to effect a specific flex mode. In a preferred embodiment, member 104*b* has a substantially square or rectangular cross-sectional shape in order to reduce torsional twisting of member 104*b.* However, member 104*b* may also have other cross-sectional shapes. In a preferred embodiment, members 104*a* and 104*c* each have a slightly oval cross-section. However, members 104*a* and 104*c* may also have other cross-sectional shapes, e.g. substantially circular cross-section, etc.

4. Use of the First and Second Embodiments

The ensuing discussion pertains to using embodiments 10 and 100 of the apparatus of the present invention. To simplify the ensuing discussion, the use of the apparatus of the present invention is described in terms of apparatus 10. However, it is to be understood that the ensuing discussion is also applicable to alternate embodiment 100.

Figure 1:
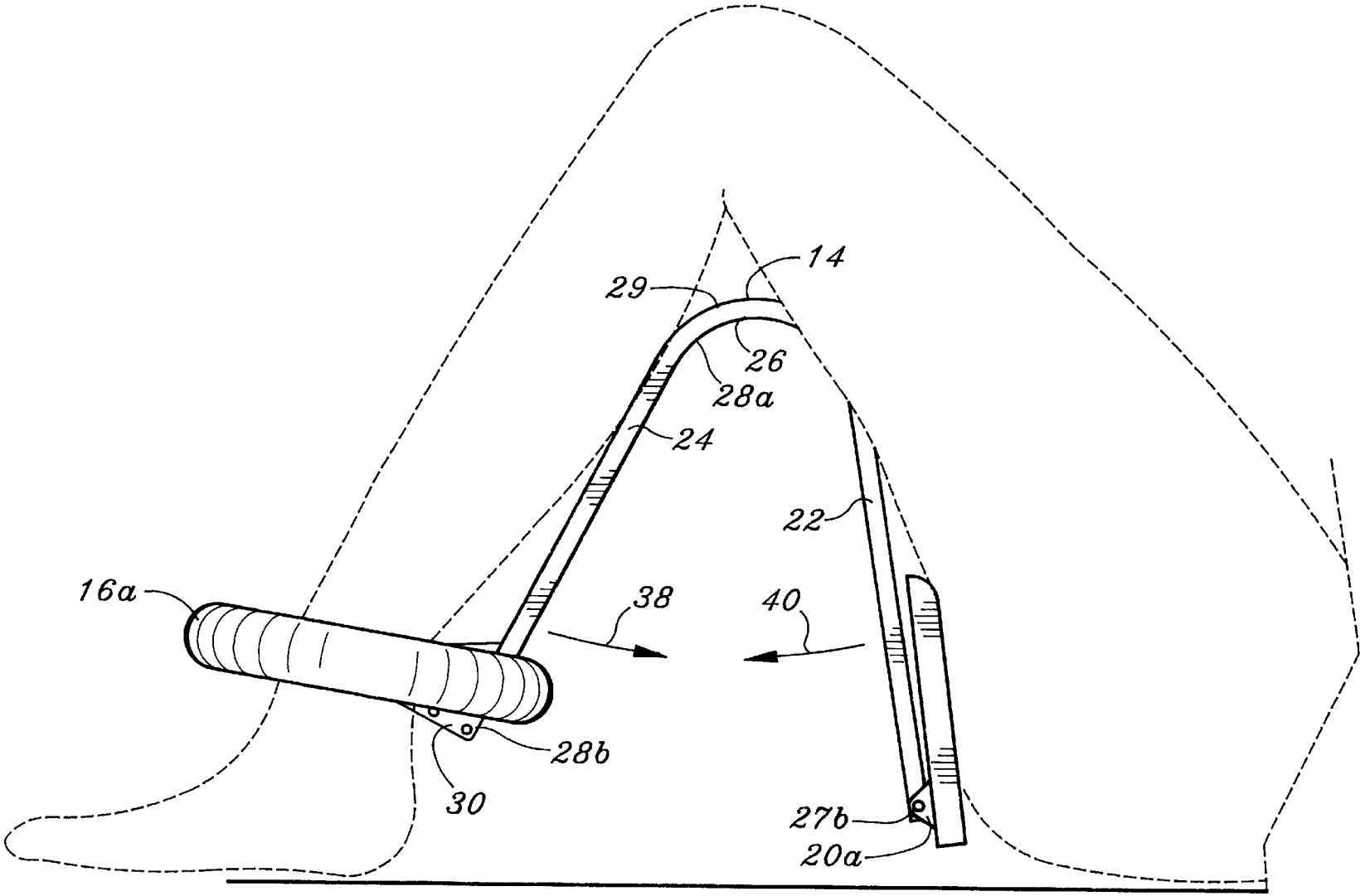
FIG. 1 illustrates the position of one embodiment of the muscle strengthening apparatus of the present invention with respect to a user, the user being shown in phantom.

When a user attempts to do "sit-up" exercises, typically the user's knees do not remain stationary and either move up or down as the user is attempting to do a "sit-up". Thus, the user's ankles move either upward and/or away from the user's buttock. Many times, the user attempts to compensate for this by exerting muscular force to hold his or her feet down to the floor. Many times, the user will have a second person hold the user's feet stationary while the user does the sit-up exercises. However, apparatus 10 of the present invention eliminates these problems. Referring to FIG. 1, when the user desires to use apparatus 10 of the present invention, the user places apparatus 10 on a flat surface, e.g. floor, and positions apparatus 10 such that (i) curved portion 29 of intermediate member 14 is positioned posteriorly and/or medially with respect to the user's knees, (ii) buttocks support member 12 is placed against the user's buttocks and (iii) the user's ankles are placed within openings 17*a* and 17*b* of members 16*a* and 16*b,* respectively. In order to achieve optimum results, the user preferably maintains both feet in contact with the floor. The user may position his or her legs in a variety of ways in order to achieve optimum results. For example, it has been found that optimum results are achieved if the user positions his or her legs in a bend between about 60° and 120° with the femur and the tibia approximately 45° with respect to the floor. It also has been found that optimum results can be achieved if the user raises her or his legs such that the knees are bent about 90° and the femur is substantially perpendicular to the floor and the tibia is substantially parallel to the floor. Although the foregoing discussion describes specific angular positions of the user's legs, it is to be understood that the actual angular orientation of the user's legs may vary with each different user of apparatus 10.

When using apparatus 10 of the present invention as shown in FIG. 1, the user's ankles, knees and buttocks all remain substantially stationary. The natural tendency for the ankles to move away from the buttocks during an unassisted crunch or sit-up is counteracted by the resistance of resilient intermediate member 14. Members 17*a* and 17*b* and curved portion 29 of member 14 cooperate to substantially eliminate movement of the user's ankles and knees during use of apparatus 10. Any force of the user's ankles exerted in the direction indicated by arrow 380 is counteracted by a substantially equal force, indicated by arrow 40, created by the user's buttock against support member 12. These forces effect a resultant compressive force on sides 22 and 24 of intermediate member 14. Since intermediate member 204 is resilient, the aforementioned compressive force causes sides 22 and 24 to approach each other. It is highly preferable that the resistance of intermediate member 14 is of a degree that prevent sides 22 and 24 from contacting each other.

Muscle strengthening apparatus 10 of the present invention effects contraction of the hamstrings by squeezing the hamstrings, in effect, moving the ankles toward the buttocks simultaneously with contraction of the abdominal muscles. Apparatus 10 of the present invention effects strengthening of the abdominal muscles while simultaneously inhibiting contraction of the psoas. Specifically, as muscle strengthening apparatus 10 contracts the hamstrings, apparatus 10 inhibits the psoas thereby providing maximum efficiency in strengthening the abdominal muscles. Support member 12 facilitates an optimum pelvic posterior tilt thereby maximizing the efficiency in strengthening and toning the abdominal muscles and obliques. Support member 12 allows the user to roll to the side to perform exercises for the obliques. Use of apparatus 12 also strengthens and tones the hamstring muscles and Gluteus Maximum.

Muscle strengthening apparatus 10 of the present invention achieves proper rectus abdominal contraction and maximizes efficiency in strengthening the abdominal muscles and obliques. Apparatus 10 effects neuro inhibition to substantially eliminate use of the hip flexors. As the user does a sit-up, apparatus 10 causes contraction of the antagonistic muscles of the hip flexors which include the gluteus maximum and hamstrings. Apparatus 10 effects contraction of these muscles to substantially eliminate activity of the hip flexors thereby achieving isolated rectus abdominis contraction.

5. Third Embodiment

Figure 9:
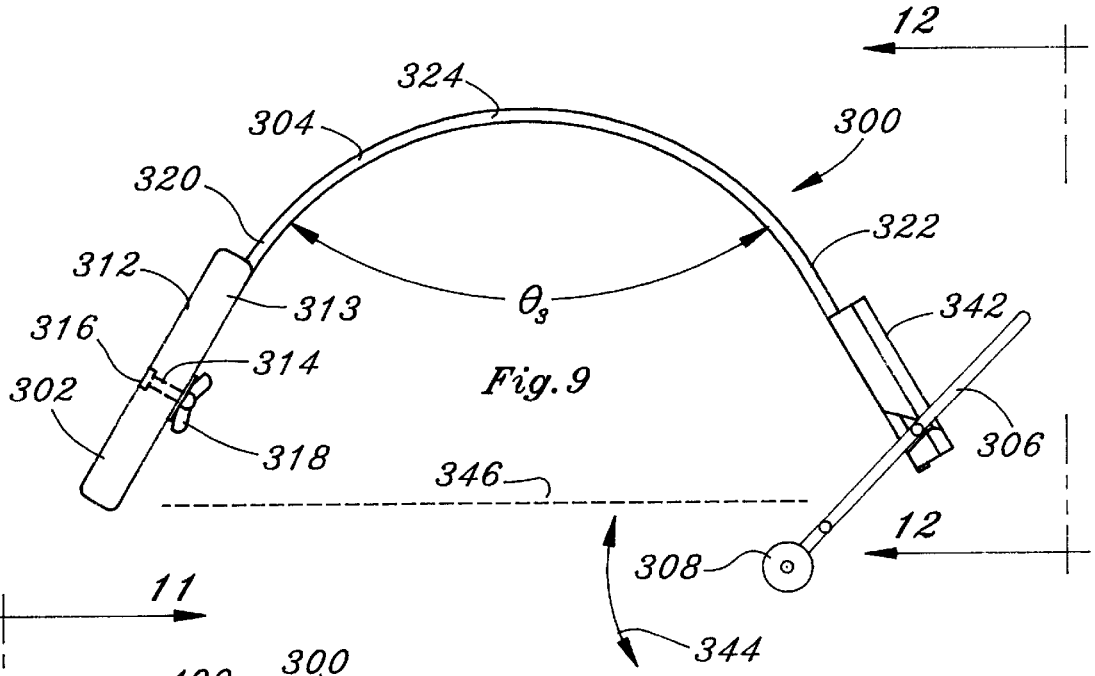
FIG. 9 is a side elevational view of the muscle strengthening apparatus shown in FIG. 8.
Figure 10:
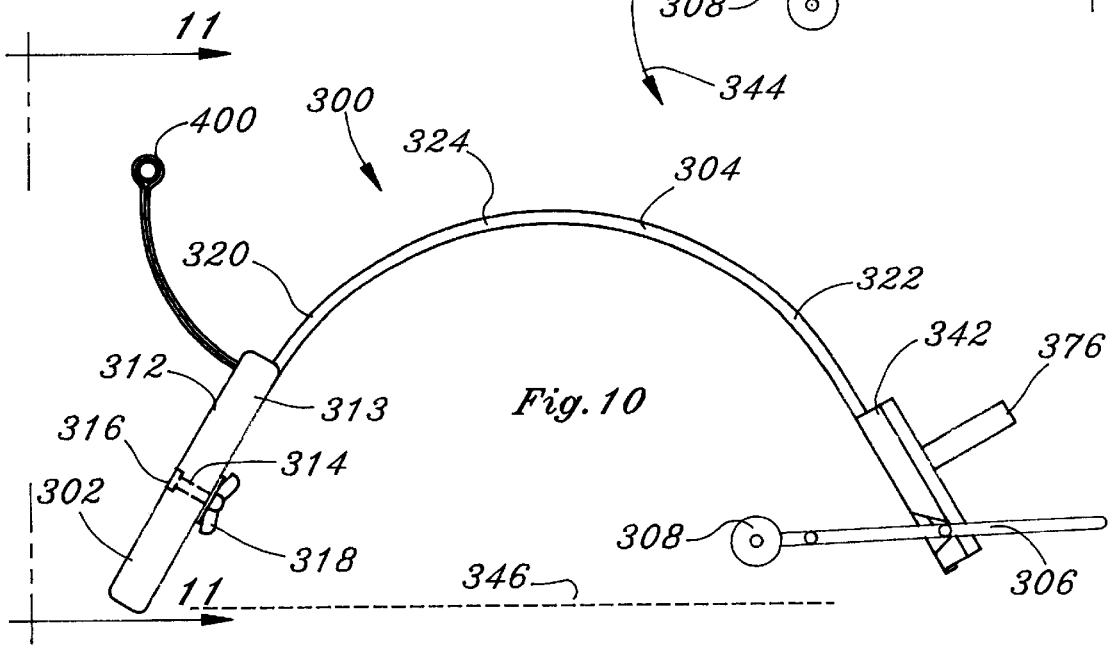
FIG. 10 is a another side elevational view of the muscle strengthening apparatus shown in FIG. 8 showing an optional bar and strap assembly, and a weight securing member.
Figure 12:
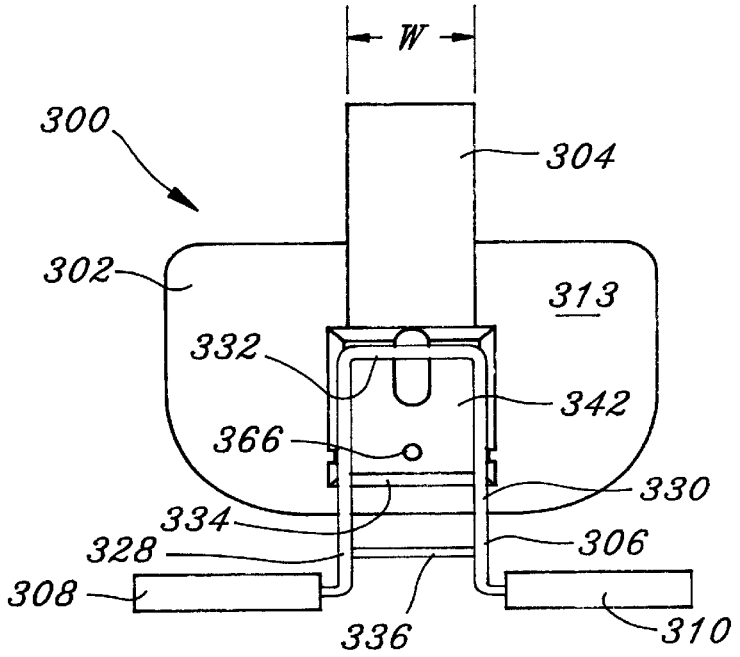
FIG. 12 is a view taken along line 12—12 of FIG. 9.
Figure 13:
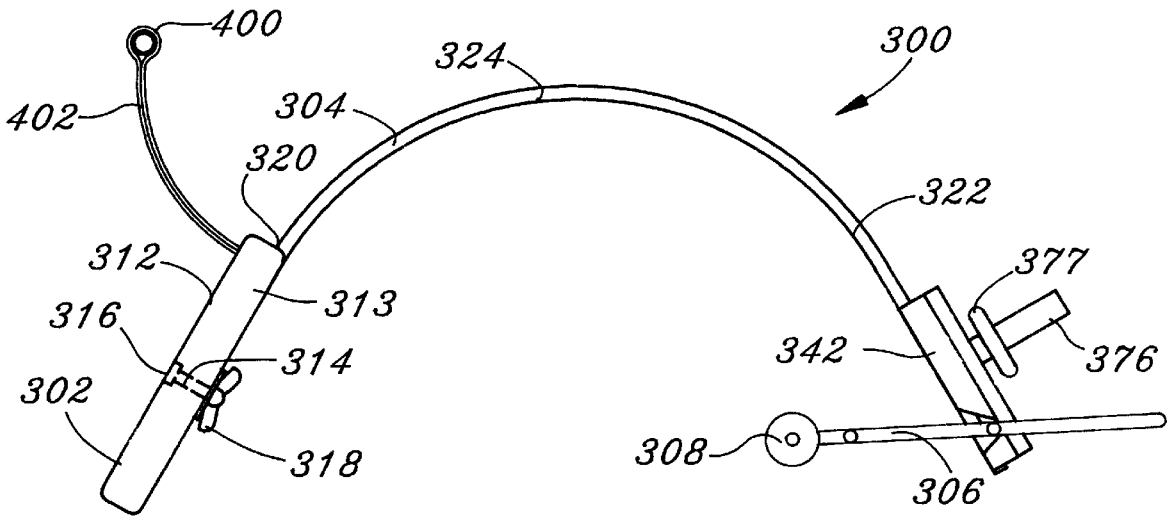
FIG. 13 is a side elevational view, the view being the same as that of FIG. 10, showing a weight securing member.

Referring to FIGS. 9, 10 and 12 there is shown a further embodiment of the muscle strengthening apparatus of the present invention. Apparatus 300 generally comprises buttocks support member 302, intermediate or central torsion member 304, support member 306 that is movable attached to intermediate member 304, and ankle contacts 308 and 310 that are attached to support member 306.

Buttocks support member 302 contacts the buttocks and/or posterior thighs of the user. In one embodiment, support member 302 has surface 312 that is configured with a predetermined contour that corresponds to the bone and muscular structure between the buttocks (gluteus maximus) and the upper hamstrings of the human anatomy. In another embodiment, support member 302 has a substantially flat surface. In a preferred embodiment, support member 302 is removably attached to intermediate member 304. In another embodiment, support member 302 has a substantially semicircular shape, is substantially rigid and is fabricated from lightweight, durable materials such as wood, plastic, rubber, fiberglass, graphite or other composite materials. Support member 302 may also have shapes other than the semicircular.

Support member 302 further includes side 313 that is opposite has side 312. In one embodiment, side 313 has a recess (not shown) that is sized for receiving a portion of intermediate member 304. The depth of the recess is substantially equal to the thickness of the aforementioned portion of the intermediate member 304. In one embodiment, support member 302 has bore 314 therethrough that is aligned with a corresponding bore (not shown) in intermediate member 304. A screw or bolt 316 is disposed through bore 314 and through the bore in intermediate member 304 and is engaged with fly nut 318. Bore 314 has a countersunk opening so as to allow the head of screw 316 to lie below the surface 312 of support member 302. It is to be understood that other methods may be used to attach support member 302 to intermediate member 304.

In a preferred embodiment, member 304 is substantially arch-shaped. Intermediate member 304 comprises portions 320 and 322. Buttocks support member 302 is attached to portion 320. Referring to FIG. 9, the midpoint of intermediate member 304 is designated generally by numeral 324. In a preferred embodiment, portions 320 and 322 are angulated with respect to each other by angle $\theta_3$. In one embodiment, $\theta_3$ is between about 55° and 70°, inclusive. In another embodiment, $\theta_3$ is between 58° and 65°, inclusive. In one embodiment, the lengths of portions 320 and 322 are substantially equal. In another embodiment, the length of portion 320 is greater than portion 322. In a further embodiment, the length of portion 322 is greater than portion 320.

In a preferred embodiment, intermediate member 304 is resilient and can be flexed or squeezed by applying a compressive force to portions 320 and 322. The thickness of member 304 depends upon the required degree of resistance or resiliency. In a preferred embodiment, member 304 is solid therethrough and has a substantially rectangular cross-sectional shape in order to reduce torsional twisting of member 304. Member 304 is preferably made from durable, flexible materials such as plastic, ABS plastic, flexiglass, fiberglass, graphite or other composite materials. However, other materials having the required durability and flexibility may also be used.

Figure 14:
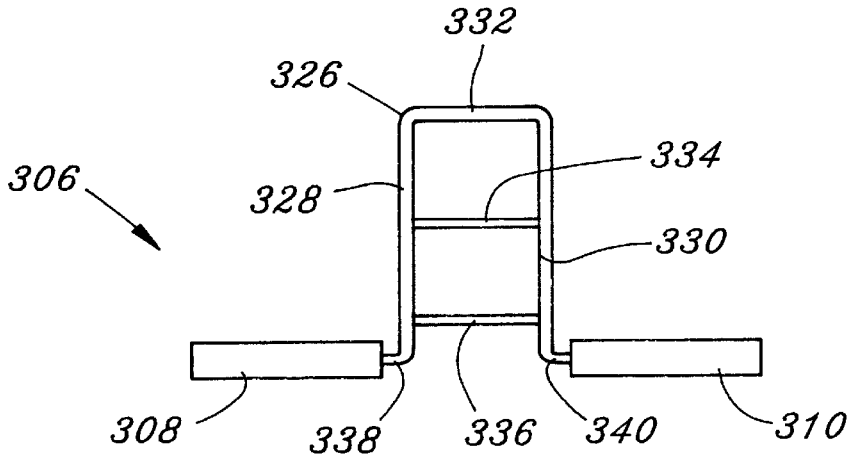
FIG. 14 is a plan view of an ankle contact support member shown in FIGS. 8–13.

Referring to FIGS. 9, 12 and 14, support member 306 is pivotally attached to portion 322 of intermediate member 304. Support member 306 comprises rigid structure 326 that has a pair of substantially parallel members 328 and 330 and lateral members 332, 334 and 336 that are attached to members 328 and 330, respectively. In addition to providing structural support, lateral members 332, 334 and 336 also provide three (3) different positions to which ankle support member 306 can be pivotally attached to portion 322 of intermediate member 324 to accommodate users of different sizes or heights. This will be discussed in detail below. The position of support member 306 also varies the degree of resistance produced when attempting to flex or squeeze member 304.

Referring to FIG. 14, structure 326 further includes elongate members 338 and 340 that are attached to and extend from members 328 and 330, respectively. Preferably, structure 326 is fabricated from durable, lightweight materials aluminum, plastic, wood, fiberglass, graphite or other composite materials. However, heavier materials can also be used such steel. In a preferred embodiment, ankle contacts 308 and 310 each have a generally cylindrical shape and define an axially extending bore (not shown) that is sized to receive elongate members 338 and 340, respectively. In an alternate embodiment, ankle contacts 308 and 310 are slightly curved. In a further embodiment, ankle contacts 308 and 310 are substantially "C" shaped. Ankle contacts 308 and 310 stabilize the feet and ankles to facilitate proper use of apparatus 300. This will be discussed in detail below. In a preferred embodiment, each ankle contacts 308 and 310 is fabricated from durable, lightweight materials such as rubber or foam rubber to provide comfort to the user. However, other materials can also be used, such as plastic, fiberglass, graphite or other composite materials. The overall structure of each ankle contacts 308 and 310 is ergonomic so as to provide comfortable physical contact between the user's ankles contact ankle contacts 308 and 310. The ergonomic design of ankle contacts 308 and 310 substantially eliminate stress and/or strain on the user's ankles.

Figure 15:
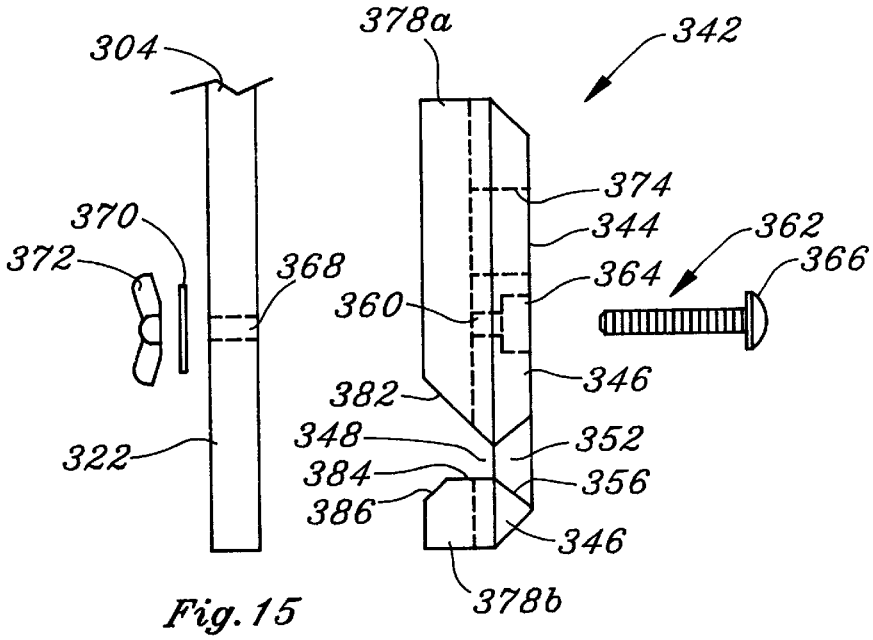
FIG. 15 is a partial, exploded view illustrating the attachment of a securement member to a substantially arch-shaped member, both of which being shown in FIG. 8, the securement member effecting removable attachment of the ankle contact support member to the arch-shaped member.
Figure 16:
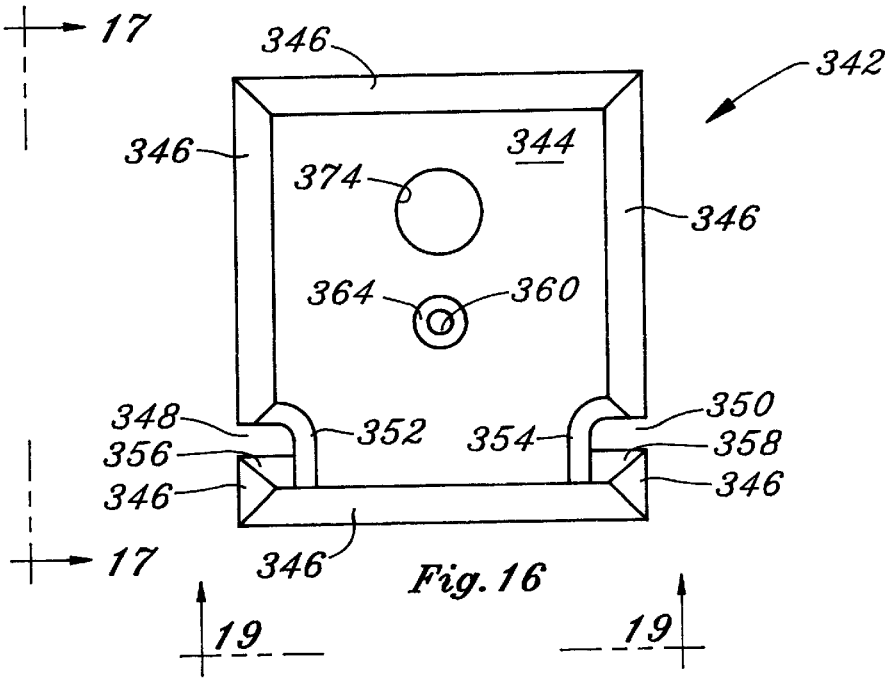
FIG. 16 is a top plan view of the securement member shown in FIG. 15.
Figure 17:
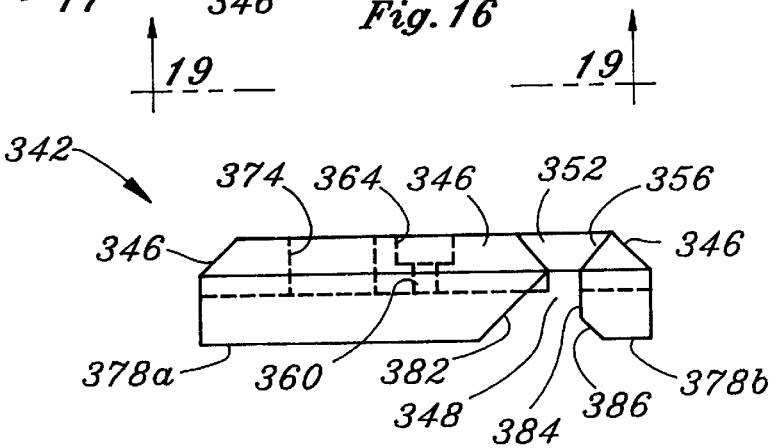
FIG. 17 is a view taken along line 17—17 of FIG. 16.
Figure 18:
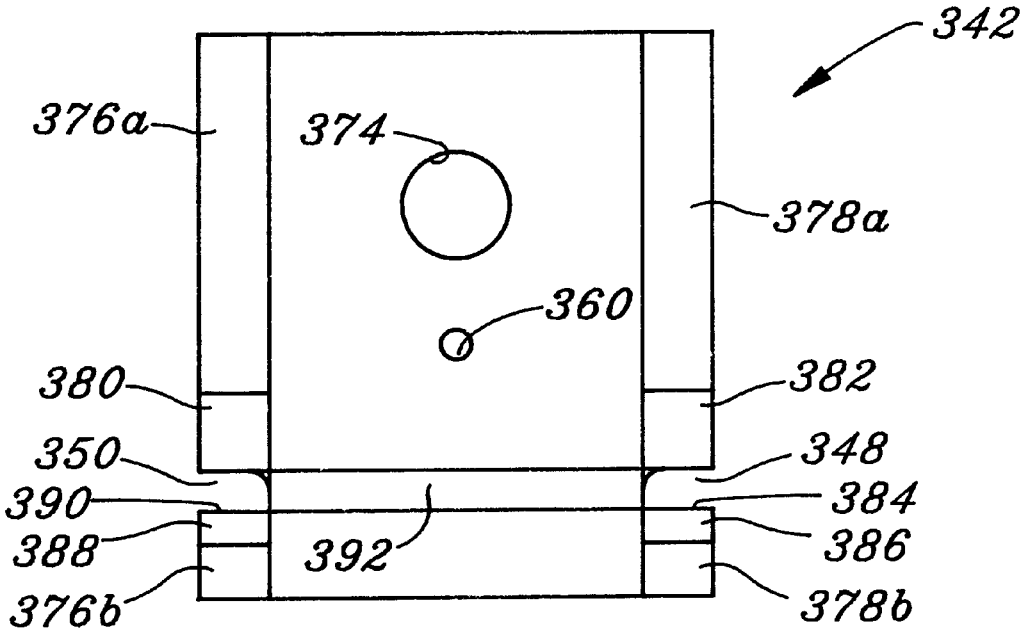
FIG. 18 is a bottom plan view of the device of FIG. 16.

Referring to FIGS. 9 and 10, apparatus 300 further includes securement member 342 which secures ankle contact support member 306 to portion 322 of intermediate member 324 but yet allows ankle support 306 to pivot in the direction indicated by arrow 344. In one preferred embodiment, ankle support 306 can pivot to positions above and below reference plane 346. In another embodiment, member 342 is configured to prevent ankle contact support member 306 to pivot below reference plane 346. Referring to FIGS. 15–17, member 342 comprises a top surface 344 and beveled edges 346. Member 342 includes notches 348 and 350. Securing member further includes beveled edges 352, 354 and beveled portions 356 and 358. Portions 356 and 358 are contiguous with beveled edges 352 and 354, respectively. Securing member 342 further includes bore 360 extending therethrough that is sized for receiving screw or bolt 362. The opening of bore 360 is countersunk so as to provide space 364 to receive head 366 of screw 362. Portion 322 of intermediate member 304 has bore 368 extending therethrough. Bore 368 is also sized for receiving screw 362. In order to removably attach member 342 to portion 322 of intermediate member 304, screw 362 is disposed through bore 360 of member 342, bore 368 of portion 322 and washer 370. Nut 372 is then threadedly engaged with screw 362. Although only one bore 368 is shown in portion 322 of member 304, it is to be understood that a plurality of bores may be used so as to enable member 342 to be moved to different positions upon portion 322. Member 342 further includes bore 374 extending therethrough for receiving elongate member 376 (see FIG. 10) to which at least one weight 377 (see FIGS. 1 and 13) are secured. In a preferred embodiment, the weight is a circular or disk-type that has an opening in the center thereof. Elongate member 376 further includes a locking member (not shown) for preventing the weight from becoming dislodged from member 376. In one embodiment, member 376 is frictionally inserted into bore 374. In another embodiment, member 376 has threads formed thereon and the inner wall of bore 374 is threaded to allow member 376 to be threadedly engaged to bore 374. In another embodiment, member 342 has a bore (not shown) that extends across member 342 and is sized for receiving a locking pin. In such an embodiment, member 376 has a pair of openings therein that are aligned with the bore in member 342 when member 376 is disposed within bore 374. The locking pin is disposed through the bore in member 342 and through the openings in member 376.

Figure 19:
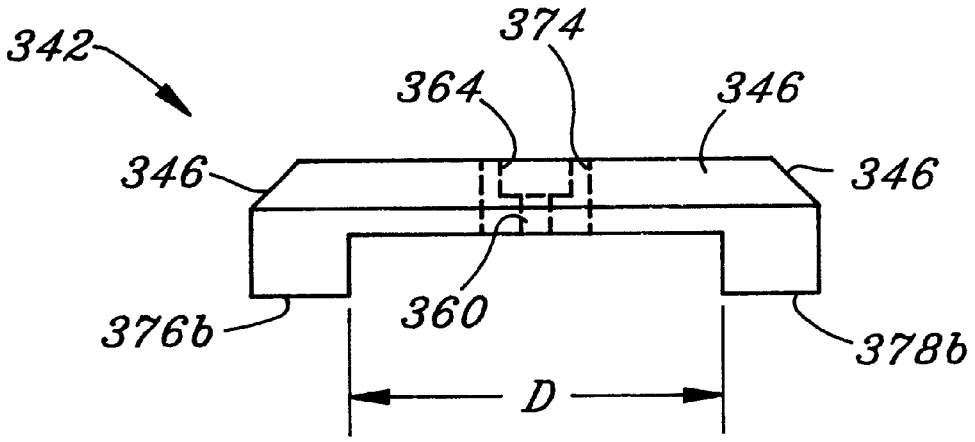
FIG. 19 is a view taken along line 19—19 of FIG. 16.
Figure 19A:
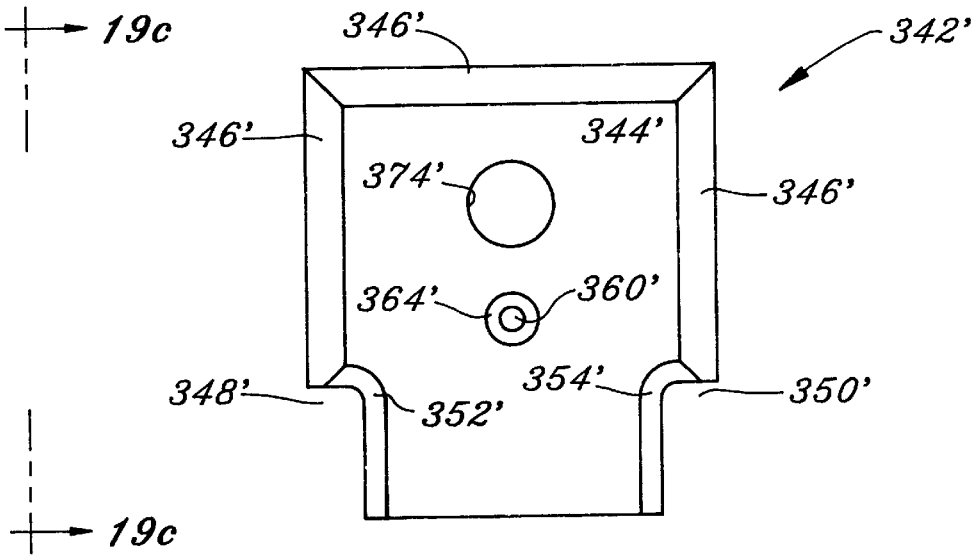
FIG. 19*a* is a top plan view of an alternate embodiment of the securement member shown in FIG. 15.
Figure 19B:
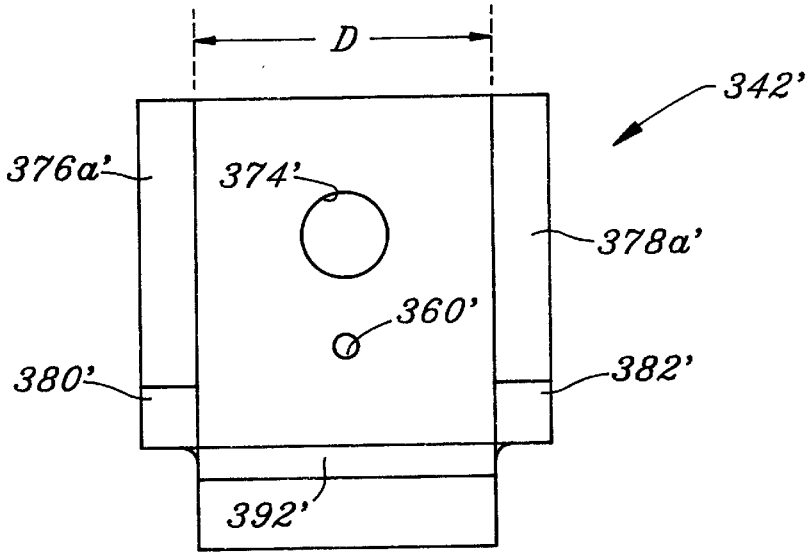
FIG. 19*b* is a bottom plan view of the alternate embodiment shown in FIG. 19*a*.
Figure 19C:
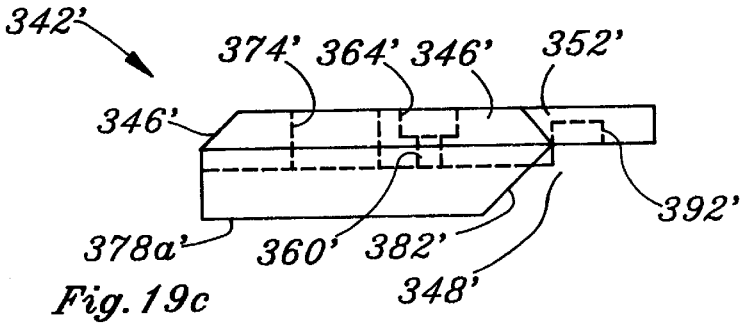
FIG. 19*c* is a view taken along line 19*c*—19*c* of FIG. 19*a*.
Figure 20:
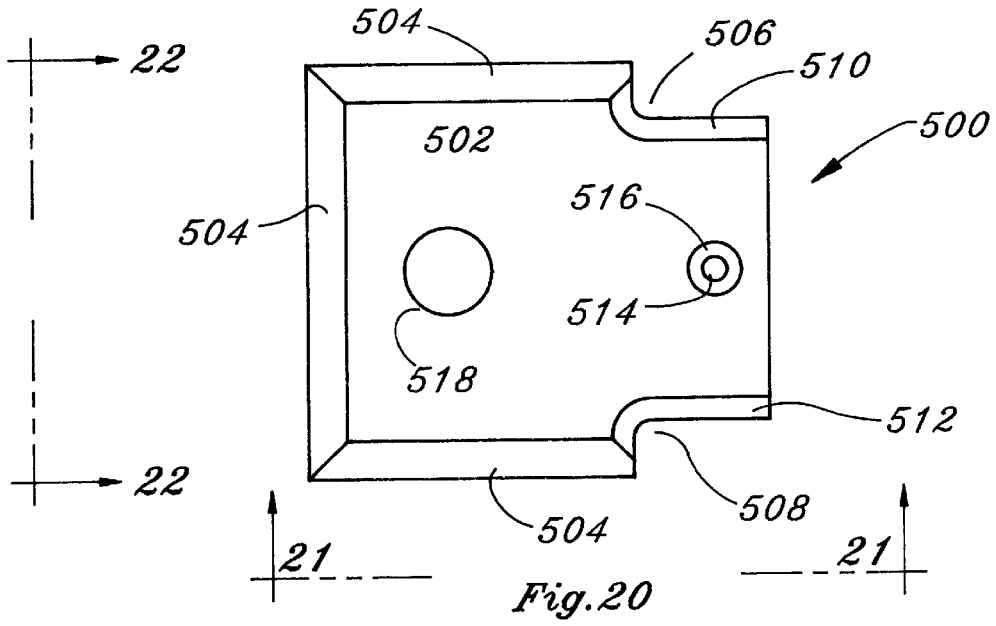
FIG. 20 is a top plan view of an alternate embodiment of the securement member shown in FIG. 15.
Figure 21:
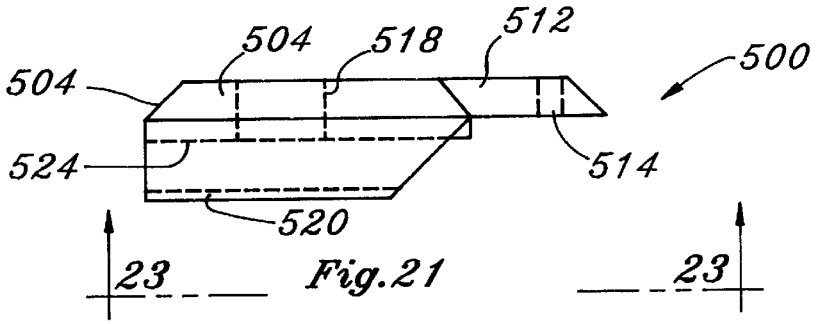
FIG. 21 is a side view taken along line 21—21 of FIG. 20.

Referring to FIGS. 19*a*, 19*b* and 19*c*, there is shown an alternate embodiment 342' of securement member 342. Member 342' provides for a greater degree of pivoting of ankle support 306. Member 342' comprises a top surface 344' and beveled edges 346'. Member 342' includes notches 348' and 350'. Member 342' further includes beveled edges 352' and 354'. Member 342' further includes bore 360' extending therethrough that is sized for receiving a screw or bolt (such as screw 362 described above). The opening of bore 360' is countersunk so as to provide space 364' to receive the head of the aforementioned screw. The aforementioned screw serves the same purpose as screw 362 described above. Member 342' further includes bore 374' extending therethrough for receiving elongate member 376 (see FIG. 10) to which at least one weight 377 (see FIGS. 1 and 13) are secured.

Referring to FIGS. 19*b* and 19*c*, member 342' further includes flanges 376*a'* and 378*a'* are separated by a distance D. The distance D is slightly greater than the width W (see FIG. 12) of intermediate member 304. Flanges 376*a'* and 378*a'* prevent any rotational movement of member 342' about screw 362. Flanges 376*a'* and 378*a'* also facilitate moving or sliding member 342' along portion 322 in order to re-position member 342' in the event portion 322' of member 304 is configured to have a plurality of bores similar to bore 368.

Referring to FIG. 19*c*, flange 376*a'* has an inclined or beveled end 380'. Similarly, flange 378*a'* has an inclined or beveled end 382'. Member 342' further includes a laterally extending channel 392' that is sized for receiving any of lateral members 332, 334 and 336 of structure 326 (see FIG. 14). Channel 392' is sized so as to allow member 306 to pivot when secured between member 342' and portion 322 of intermediate member 304. The degree of inclination of beveled edges 352' and 354' and surfaces 380' and 382' determines the angular range within which ankle support member 306 can pivot. This angular range can be varied by varying the degree of inclination of beveled edges 352', 354', and of surfaces 380', 382'.

Referring to FIGS. 8, 10, 11 and 13, in an alternate embodiment, apparatus 300 further includes elongate member 400 and attachment member 402. In one embodiment, elongate member 400 is rigid and covered with a material that is soft but yet durable, e.g. foam rubber, cloth or other types of padding. In one embodiment, member 402 is a flexible, adjustable strap that can be formed into a loop the size of which can be adjusted. Member 402 is disposed through an opening or bore 404 that extends through buttocks support 302 (see FIG. 11). The ends of the member 402 are removably fastened together to form the aforementioned loop. One end of member 402 has a fastener member and the other end of member 402 has a complementary fastener member that allows the flexible member to be configured into a loop wherein the size of the loop can be adjusted. In a preferred embodiment, a buckle configuration is used to attach both ends of the strap. If member 402 is configured as an adjustable strap, it is preferred that the strap is fabricated from textile materials, e.g. polyester, nylon, dacron, leather, etc. In another embodiment, member 402 comprises an elastic band having one end attached to buttocks support member 302 and the other end attached to elongate member 400. However, member 402 can have other configurations.

Figure 8:
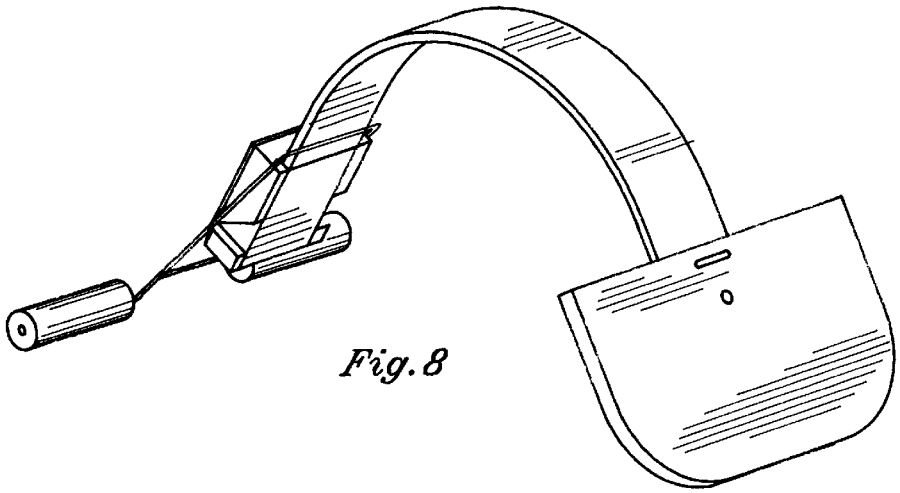
FIG. 8 is a perspective view of a further embodiment of the muscle strengthening apparatus of the present invention.

Members 400 and 402 enable the user to maintain buttock support member 302 in firm, physical contact with the user's buttocks or rear portions of the user's thighs. Referring to FIG. 8, during use of apparatus 300, elongate member 400 is inserted within the loop formed by member 402 and the loop is tightened so that elongate member 400 is pressed against the legs (the thighs) of the user. This is explained below in detail.

Referring to FIGS. 20, 21, 22 and 23, there is shown a further embodiment 500 of securement member 342. Member 500 also provides for a greater degree of pivoting of ankle support 306. Member 500 comprises a top portion 502 and beveled edges 504. Member 500 includes notches 506 and 508. Member 500 further includes beveled edges 510 and 512. Member 500 further includes bore 514 extending therethrough that is sized for receiving a screw or bolt (such as screw 362 described above). The opening of bore 514 is countersunk so as to provide space 516 to receive the head of the aforementioned screw. The aforementioned screw serves the same purpose as screw 362 described above. Member 500 further includes bore 518 extending therethrough for receiving elongate member 376 (see FIG. 10) to which at least one weight 377 (see FIGS. 1 and 13) are secured.

Figure 22:
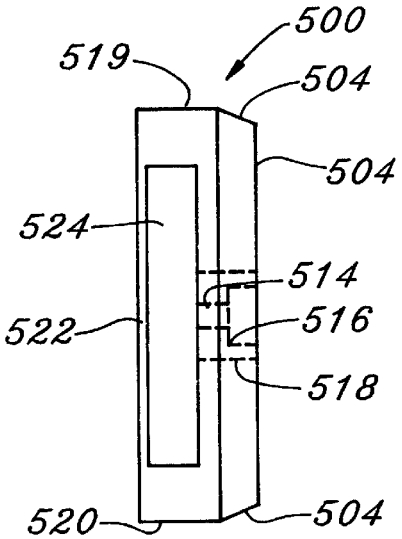
FIG. 22 is an end view taken along line 22—22 of FIG. 20.
Figure 23:
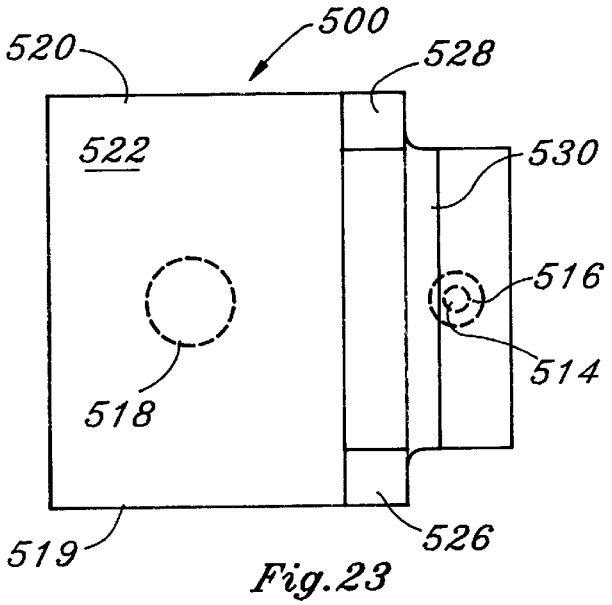
FIG. 23 is a bottom plan view taken along line 23—23 of FIG. 21.

Referring to FIG. 22, member 500 further includes wall portions 519 and 520 that are attached to top portion 502, and bottom portion 522 that is attached to wall portions 518 and 520. Top portion 502, wall portions 519 and 520 and bottom portion 522 define bore 524 that is sized for receiving portion 322 of member 304. The size of bore 524 permits member 500 to be slidably move along member 304.

Referring to FIG. 19*c,* wall portion 519 has an inclined or beveled end 526. Similarly, flange 520 has an inclined or beveled end 528. Member 500 further includes a laterally extending channel 530 that is sized for receiving any of lateral members 332, 334 and 336 of structure 326 (see FIG. 14). Channel 500 is sized so as to allow member 306 to pivot when secured between member 500 and portion 322 of intermediate member 304. The degree of inclination of beveled edges 506 and 508 and ends 526 and 528 determines the angular range within which ankle support member 306 can pivot. This angular range can be varied by varying the degree of inclination of edges 506 and 508 and ends 526 and 528.

6. Use of the Third Embodiment

The ensuing discussion pertains to using embodiment 300 of the apparatus of the present invention.

As stated above, when a user attempts to do "sit-up" exercises, typically the user's knees do not remain stationary and either move up or down as the user is attempting to do a "sit-up". Thus, the user's ankles move either upward and/or away from the user's buttock. Many times, the user attempts to compensate for this by exerting muscular force to hold his or her feet down to the floor. Many times, the user will have a second person hold the user's feet stationary while the user does the sit-up exercises. However, apparatus 300 of the present invention eliminates these problems.

As will be seen by the ensuing description, apparatus 300 may be used in several different ways to achieve effects contraction of the hamstring muscles.

Figure 8A:
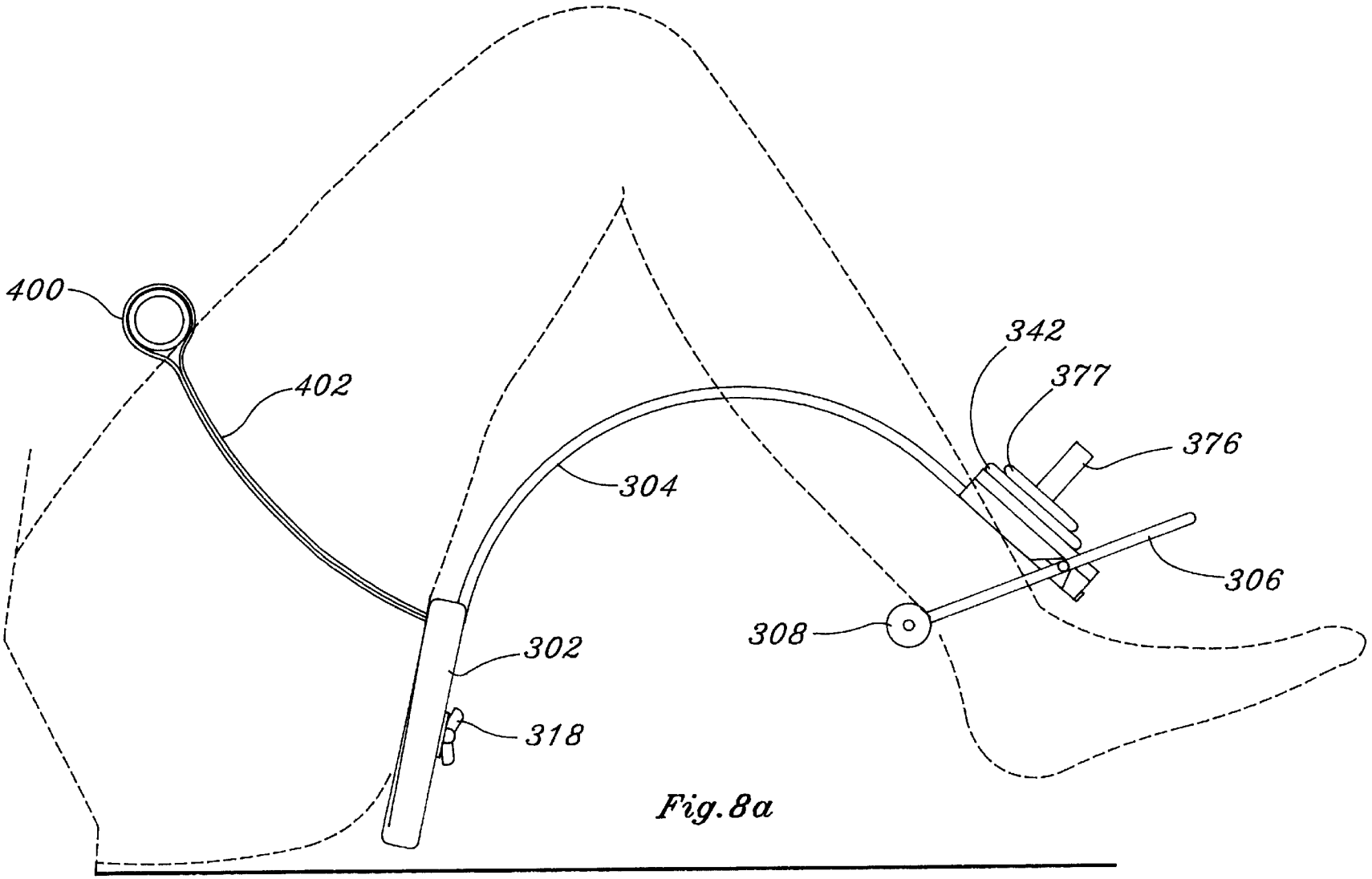
FIG. 8*a* illustrates one method of using the muscle strengthening apparatus of FIG. 8.
Figure 8B:
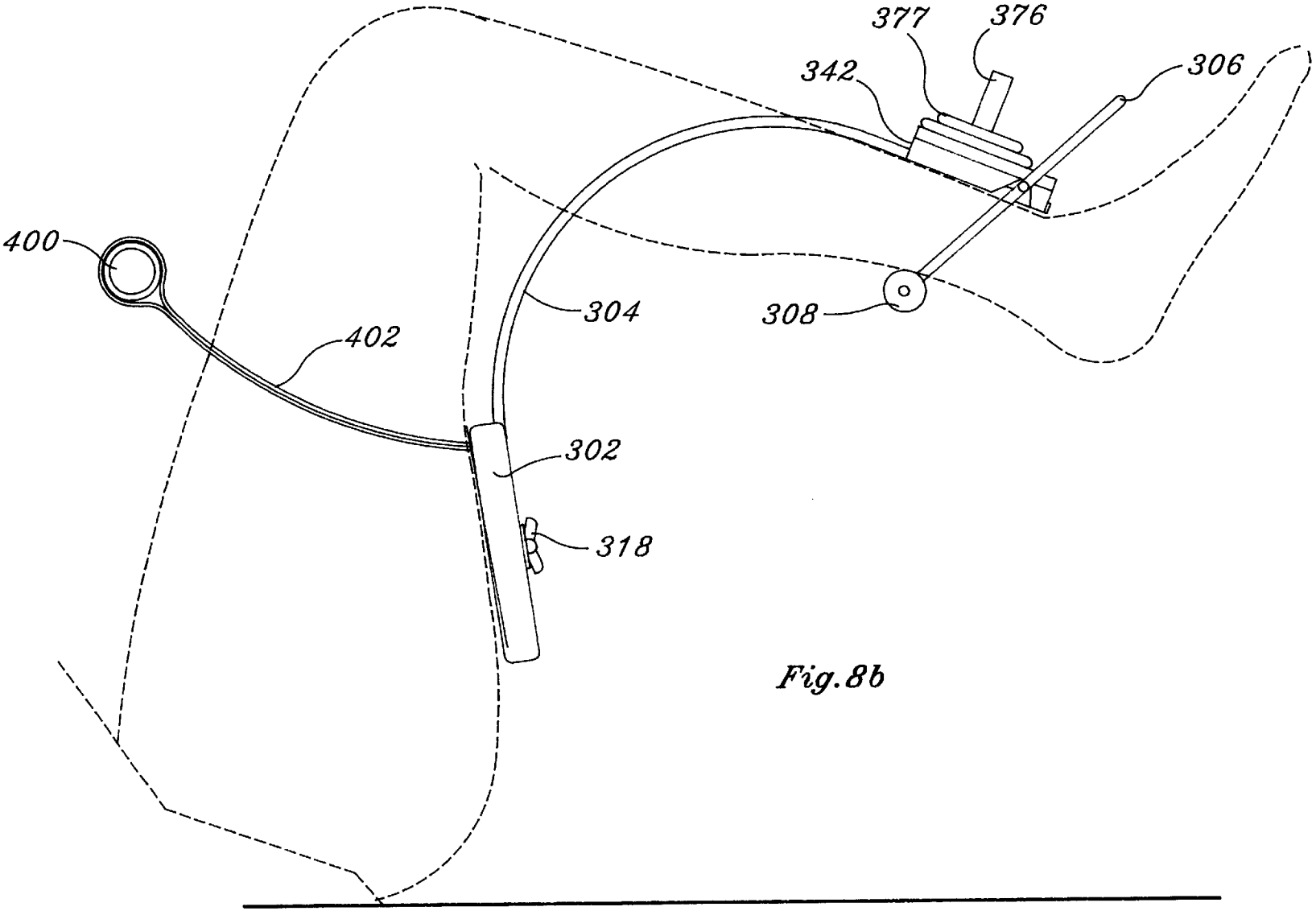
FIG. 8*b* illustrates another method of using the muscle strengthening apparatus of FIG. 8.
Figure 11:
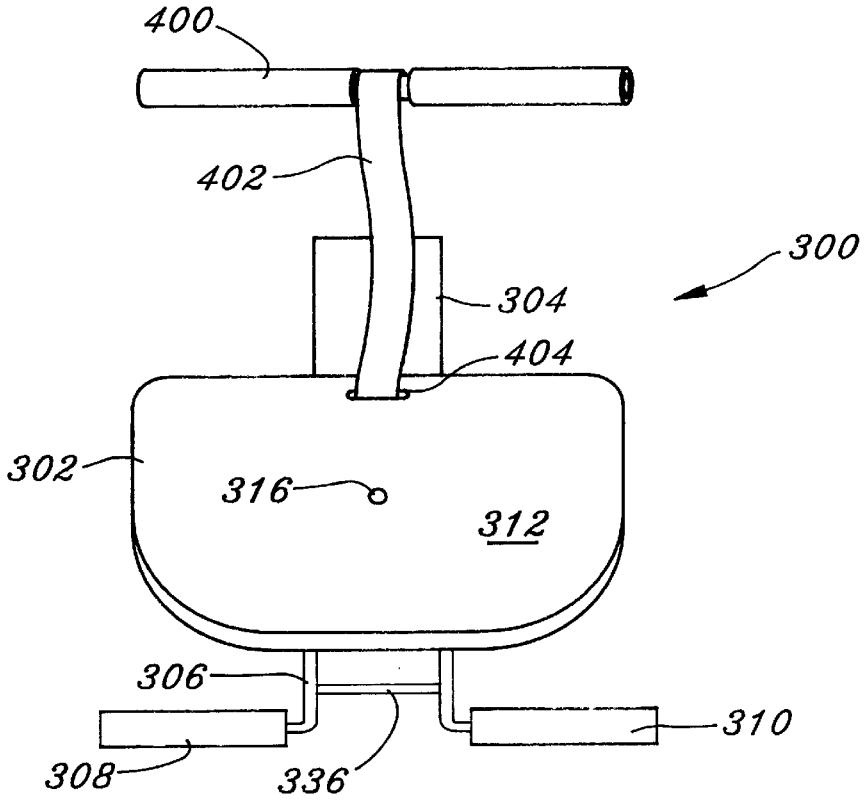
FIG. 11 is a view taken along line 11—11 of FIG. 10.

Referring to FIGS. 8*a* and 8*b,* when the user desires to use apparatus 300 of the present invention, the user places apparatus 300 on a flat surface, e.g. floor, and positions apparatus 300 such that (i) midpoint 324 of intermediate member 304 is positioned posteriorly and/or medially with respect to the user's knees, (ii) buttocks support member 302 is placed against the user's buttocks and (iii) the user's ankles are positioned against ankle contacts 308 and 310 as shown in FIGS. 8*a* and 8*b*. The user may position his or her legs in a variety of ways in order to achieve optimum results. For example, it has been found that optimum results are achieved if the user positions his or her legs in a bend between about 60° and 120° with the femur and the tibia approximately 45° with respect to the floor. It also has been found that optimum results can be achieved if the user raises her or his legs such that the knees are bent about 90° and the femur is substantially perpendicular to the floor and the tibia is substantially parallel to the floor. Although the foregoing discussion describes specific angular positions of the user's legs, it is to be understood that the actual angular orientation of the user's legs may vary with each different user of apparatus 300.

If members 400 and 402 are used, then the user configures flexible member 402 into a loop, positions the loop between his or her legs, inserts elongate member 400 into the loop and positions elongate member 400 such that when the loop is tightened, elongate member 400 is pressed against the thighs of the user.

In one method, apparatus 300 effects contraction of the hamstring muscles when (i) the user's buttocks contacts the buttocks contact member 302, (ii) the user's ankles contact the ankle contact portions 308 and 310, (iii) the user lies on his or her back, (iv) the user maintains his or her feet on the floor while simultaneously maintaining the ankles in contact with ankle contacts 308 and 310, (v) the user moves his or her feet toward the user's gluteus maximus muscle so as to squeeze or flex arch-shaped member 304 whereby the resistance of arch-shaped member 304 induces contraction of the hamstring muscles, and (vi) the user performs a sit-up.

Referring FIG. 8*a,* in another method, apparatus 300 effects contraction of the hamstring muscles when (i) the user's buttocks contacts the buttocks contact member 302, (ii) the user's ankles contact the ankle contact portions 308 and 310, (iii) the user lies on his or her back, (iv) the user raises his or her feet between about ½" and 3 inches, inclusive, above the floor while simultaneously maintaining the ankles in contact with ankle contacts 308 and 310, (v) the user moves his or her feet toward the user's gluteus maximus muscle so as to squeeze or flex arch-shaped member 304 whereby the resistance of arch-shaped member 304 induces contraction of the hamstring muscles, and (vi) the user performs a sit-up.

Referring to FIG. 8*b,* in a further method, apparatus 300 effects contraction of the hamstring muscles when (i) the user positions member 402 between the user's thighs and then adjusts member 402 so that bar 400 is firmly pressed against the top portion of the user's legs as shown in FIG. 8*b,*

(ii) the user's buttocks and/or the posterior thighs of the user contact member 302, (iii) the user's ankles contact the ankle contacts 308 and 310, (iv) the user lies on his or her back, (v) the user raises his or her legs by pivoting the femurs at the hips (bent knee leg raises) while simultaneously maintaining the ankles in contact with the ankle contacts 308 and 310 (weights can be secured to member 376 in order to effect a desired level of intensity), (vi) the user moves his or her feet toward the user's gluteus maximus muscle so as to squeeze or flex arch-shaped member 304 whereby the resistance of arch-shaped member 304 induces contraction of the hamstring muscles, and (vii) the user performs a reverse-torso crunch.

In a further method, apparatus 300 effects contraction of the hamstring muscles when (i) the user positions member 402 between the user's thighs and then adjusts member 402 so that bar 400 is firmly pressed against the top portion of the user's legs as shown in FIG. 8*b,*

(ii) the user's buttocks and/or the posterior thighs of the user contact member 302, (iii) the user's ankles contact the ankle contacts 308 and 310, (iv) the user lies on his or her back, (v) the user raises his or her legs by pivoting the femurs at the hips (bent knee leg raises) while simultaneously maintaining the ankles in contact with the ankle contacts 308 and 310 (weights can be secured to member 376 in order to effect a desired level of intensity), (vi) the user moves his or her feet toward the user's gluteus maximus muscle so as to squeeze or flex arch-shaped member 304 whereby the resistance of arch-shaped member 304 induces contraction of the hamstring muscles, and (vii) the user performs a "V" crunch. This is accomplished by pivoting the femurs toward the hip or torso line (from about 45° to about 90°) while simultaneously contracting the rectus abdominus and/or obliques which raises the shoulders off of the floor in performing a sit-up.

Thus, the contact between the user's buttocks (and/or the rear portions of the user's thighs) and buttocks contact member 302, and the force exerted upon ankle contacts 308 and 310 by the user's ankles while the user is attempting to perform a sit-up effect a resultant compressive force on portions 320 and 322 of intermediate member 304. Since intermediate member 304 is resilient, the aforementioned compressive force causes portions 320 and 322 to approach each other. It is highly preferable that the resistance of intermediate member 304 is of a degree that prevent portions 320 and 322 from contacting each other.

The user can achieve optimum abdominal conditioning in relatively less time by adding weights to member 376 so as to increase the force needed to be overcome in order to achieve proper contraction of the hamstrings.

Muscle strengthening apparatus 300 of the present invention effects contraction of the hamstrings by squeezing the hamstrings, in effect, moving the ankles toward the buttocks simultaneously with contraction of the abdominal muscles. Apparatus 300 of the present invention effects strengthening of the abdominal muscles while simultaneously inhibiting contraction of the psoas. Specifically, as muscle strengthening apparatus 300 contracts the hamstrings, apparatus 300 inhibits the psoas thereby providing maximum efficiency in strengthening the abdominal muscles. Support member 302 facilitates an optimum pelvic posterior tilt thereby maximizing the efficiency in strengthening and toning the abdominal muscles and obliques. Support member 302 allows the user to roll to the side to perform exercises for the obliques. Use of apparatus 300 also strengthens and tones the hamstring muscles and Gluteus Maximum.

Muscle strengthening apparatus 300 of the present invention achieves proper rectus abdominal contraction and maximizes efficiency in strengthening the abdominal muscles and obliques. Apparatus 300 effects neuro inhibition to substantially eliminate use of the hip flexors. As the user does a sit-up, apparatus 300 causes contraction of the antagonistic muscles of the hip flexors which include the gluteus maximum and hamstrings. Apparatus 300 effects contraction of these muscles to substantially eliminate activity of the hip flexors thereby achieving isolated rectus abdominis contraction.

Thus, the apparatuses 10, 100 and 300 of the present invention:

a) maximize the efficiency in toning and strengthening abdominal muscles, lower abdominal muscles (separate from "hip flexors") and obliques;

b) effect toning and strengthening of other muscles, e.g. hamstrings and gluteus maximum, simultaneously with and in addition to the abdominal muscles;

c) facilitate correct pelvic tilt;

d) achieves significant increase in strength of abdominal muscles over a relatively short period of time;

e) prevent over development of the iliopsoas or hip flexors;

f) can be used with optional weights;

g) are lightweight and compact;

h) are inexpensive to manufacture;

i) are easy and convenient to use;

j) are transportable and easy to store; and k) allow users of different sizes or heights to use the apparatus of the present invention in a comfortable and efficient manner.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

What is claimed is:

1. An abdominal muscle conditioning apparatus comprising:

a substantially ached-shaped member having a first end and a second end, the arched-shaped member having a predetermined degree of resiliency;

a buttocks contact member having a surface for receiving the buttocks of the user, the buttocks contact member being attached to the arch-shaped member adjacent the first end such that the surface faces away from the arch-shaped member; and an ankle contact member attached to the arch-shaped member adjacent to the second end, the ankle contact member having a pair of ankle support members oppositely positioned on either side of the arch-shaped member for for receiving the ankles of a user, each ankle support member comprising an extending member that extends outwardly from the ankle contact member and away from the arch-shaped member so as to enable the user to compress the first and second ends of the substantially arch-shaped member toward each other when the user's buttocks is received by the surface of the buttocks contact member and the user's ankles are received by the ankle support members.

2. The muscle strengthening apparatus according to claim 1 wherein the arched-shaped member has a substantially rectangular-shaped cross section.

3. The muscle strengthening apparatus according to claim 1 wherein the ankle contact member is removably attached to the arch-shaped member.

4. The muscle strengthening apparatus according to claim 1 wherein the ankle contact member is pivotally attached to the arch-shaped member.

5. The muscle strengthening apparatus according to claim 1 further including a device for removably attaching the ankle contact member to the arch-shaped member.

6. The muscle strengthening apparatus according to claim 1 wherein the ankle contact member is movably attached to the arch-shaped member thereby allowing the position of the ankle contacts to be adjusted so as to accommodate users of different sizes.

7. The abdominal muscle conditioning apparatus according to claim 1 wherein the surface of the buttocks contact member is substantially planar and is sized to receive the buttocks and the posterior thighs of the user.

8. The abdominal muscle conditioning apparatus according to claim 1 wherein each ankle support member has a substantially circular cross-sectional shape.

9. The abdominal muscle conditioning apparatus according to claim 1 wherein each ankle support member includes padded material for contacting the ankles of the user.

10. The muscle strengthening apparatus according to claim 5 further comprising means for removably securing at least one weight to the device.

11. The muscle strengthening apparatus according to claim 5 wherein the device is removably secured to the arch-shaped member.

12. The muscle strengthening apparatus according to claim 1 further comprising an elongate member;

a flexible member having one end attached to the elongate member and another end attached to the buttocks contact member; and means attached to the flexible member for adjusting the distance between the elongate member and the buttocks contact member.

13. An abdominal muscle conditioning apparatus comprising:

a generally arcuate shaped single piece member extending between a first end and a second end, the single piece member having a predetermined degree of resiliency;

a support member having a surface for receiving the buttocks of the user, the support member being attached to the second end of the single piece member such that the surface faces away from the single piece member; and an ankle contact member attached to the first end of the single piece member, the ankle contact member having a pair of ankle support members oppositely positioned on either side of the single piece member for receiving the ankles of a user, each ankle support member comprising an extending member that extends outwardly from the ankle contact member so as to enable the user to compress the first and second ends of the single piece member toward each other when the user's buttocks is received by the surface of the buttocks contact member and the user's ankles are received by the ankle support members.

14. The abdominal muscle conditioning apparatus according to claim 13 wherein the ankle contact member is pivotally attached to the first end of the single piece member.

15. The abdominal muscle apparatus according claim 13 wherein the single piece member and the support member are fabricated from plastic.

16. An abdominal muscle conditioning apparatus comprising:

a resilient member comprising a first portion and a second portion, the first and second portions being angulated with respect to each other, the first and second portions each having an end opposite the point of contiguity of the first and second portions;

a buttocks support member having a surface for receiving the buttocks of the user, the buttocks support member being attached to the end of the second portion such that the surface faces away from the second portion of the resilient member;

an ankle contact member attached to the end of the first portion, the ankle contact member having a pair of ankle support members oppositely positioned on either side of the resilient member for receiving the ankles of a user, each ankle support member comprising a member that extends outwardly from the ankle support member so as to enable the user to compress the first and second portions of the resilient member toward each other when the user's buttock is received by the surface of the buttocks support member and the user's ankles are received by the ankle support members.

17. The abdominal muscle conditioning apparatus according to claim 16 wherein the feet securing member is pivotally attached to the end of the first portion.

* * * * *

UNITED STATES PATENT AND TRADEMARK OFFICE

CERTIFICATE OF CORRECTION

PATENT NO. : 6,231,487 B1
DATED : May 15, 2001
INVENTOR(S) : Diamond et al.

It is certified that error appears in the above-identified patent and that said Letters Patent is hereby corrected as shown below:

Column 14,
Line 59, delete "contacts" and substitute therefor -- support members --.

Signed and Sealed this

Sixth Day of August, 2002

*Attest:*

*Attesting Officer*

JAMES E. ROGAN
*Director of the United States Patent and Trademark Office*